US007325363B2

(12) United States Patent
Davis

(10) Patent No.: US 7,325,363 B2
(45) Date of Patent: Feb. 5, 2008

(54) FOUNDATION SYSTEM FOR PREFABRICATED HOUSES

(76) Inventor: S. Michael Davis, 137 11th St. SW., Watertown, SD (US) 57201

( * ) Notice: Subject to any disclaimer, the term of this patent is extended or adjusted under 35 U.S.C. 154(b) by 296 days.

(21) Appl. No.: 10/637,806

(22) Filed: Aug. 7, 2003

(65) Prior Publication Data

US 2005/0028457 A1 Feb. 10, 2005

(51) Int. Cl.
*E02D 31/02* (2006.01)
*E02D 31/08* (2006.01)

(52) U.S. Cl. ..... 52/169.12; 52/DIG. 11; 52/DIG. 3; 52/293.3; 52/293.1; 52/299; 256/65.14

(58) Field of Classification Search ..... 52/299, 52/169.12, 294, 297, 296, 293.1, DIG. 11, 52/DIG. 3, 293.3, 292; 256/65.14, 24, 73; 280/768
See application file for complete search history.

(56) References Cited

U.S. PATENT DOCUMENTS

| | | | | | |
|---|---|---|---|---|---|
| 1,764,001 | A | * | 6/1930 | Blanchard | 52/206 |
| 3,216,163 | A | * | 11/1965 | Carew | 52/251 |
| 3,295,278 | A | | 1/1967 | Muhm | 52/223 |
| 3,350,824 | A | * | 11/1967 | Wiebusch | 52/251 |
| 3,753,323 | A | | 8/1973 | Nesbitt | 52/169 |
| 3,832,813 | A | * | 9/1974 | Hindman | 52/169.12 |
| 3,837,127 | A | | 9/1974 | McMichael et al. | 52/126 |
| 3,879,905 | A | * | 4/1975 | Catalano, Sr. | 52/23 |
| 4,001,990 | A | | 1/1977 | Chase et al. | 52/167 |
| 4,007,568 | A | | 2/1977 | Soble | 52/294 |
| 4,043,088 | A | * | 8/1977 | Payton | 52/169.12 |
| 4,107,889 | A | * | 8/1978 | Gonsalves et al. | 52/259 |
| 4,222,208 | A | * | 9/1980 | Ferver | 52/169.5 |
| 4,275,538 | A | * | 6/1981 | Bounds | 52/299 |
| 4,485,598 | A | | 12/1984 | Guardiani | 52/79.1 |
| 4,787,475 | A | * | 11/1988 | Arteau et al. | 182/82 |
| 4,841,691 | A | * | 6/1989 | Stoecker | 52/169.12 |
| 4,918,891 | A | | 4/1990 | Gerszweski | 52/295 |
| 4,944,124 | A | * | 7/1990 | Armstrong | 52/169.12 |
| 5,067,289 | A | | 11/1991 | Ouderkirk et al. | 52/169 |
| 5,095,674 | A | | 3/1992 | Huettemann | 52/407 |
| 5,277,408 | A | * | 1/1994 | Parker | 256/65.02 |
| 5,755,064 | A | * | 5/1998 | Meyer et al. | 52/174 |
| 5,870,861 | A | * | 2/1999 | Gnaedinger | 52/93.1 |
| 5,890,334 | A | * | 4/1999 | Hughes, Jr. | 52/299 |
| 6,076,320 | A | * | 6/2000 | Butler | 52/294 |
| 6,094,873 | A | | 8/2000 | Hoffman et al. | 52/126.6 |
| 6,125,597 | A | | 10/2000 | Hoffman et al. | 52/169.12 |
| 6,173,945 | B1 | * | 1/2001 | Lindsey et al. | 256/24 |
| 6,205,720 | B1 | * | 3/2001 | Wolfrum | 52/169.12 |

(Continued)

*Primary Examiner*—Richard Chilcot
*Assistant Examiner*—Phi Dieu Tran A

(57) ABSTRACT

A prefabricated foundation is provided using a plurality of concrete panels that are cast at a factory location to a predetermined uniform form and size. These panels are of a generally rectangular shape and are positioned end to end forming a wall-like structure around the entire perimeter of a prefabricated structure. The lower surface of the panels are then supported by a plurality of precast posts that correspond in position and number to the joints between the plurality of panels. The joint between two abutting precast panels is sealed to provide a weather tight fit between the exterior and interior of the panels. The upper edge of the precast panels are locked in position keeping them from moving in either an inward or outward manner thereby providing a stable platform upon which a prefabricated structure can be placed.

17 Claims, 3 Drawing Sheets

U.S. PATENT DOCUMENTS 6,453,627 B1 * 9/2002 Powers ..... 52/169.12
6,796,089 B1 * 9/2004 Campbell ..... 52/168
2003/0033773 A1 * 2/2003 Houpapa et al. ..... 52/299
2003/0188497 A1 * 10/2003 Price ..... 52/169.12

* cited by examiner

FIG 1
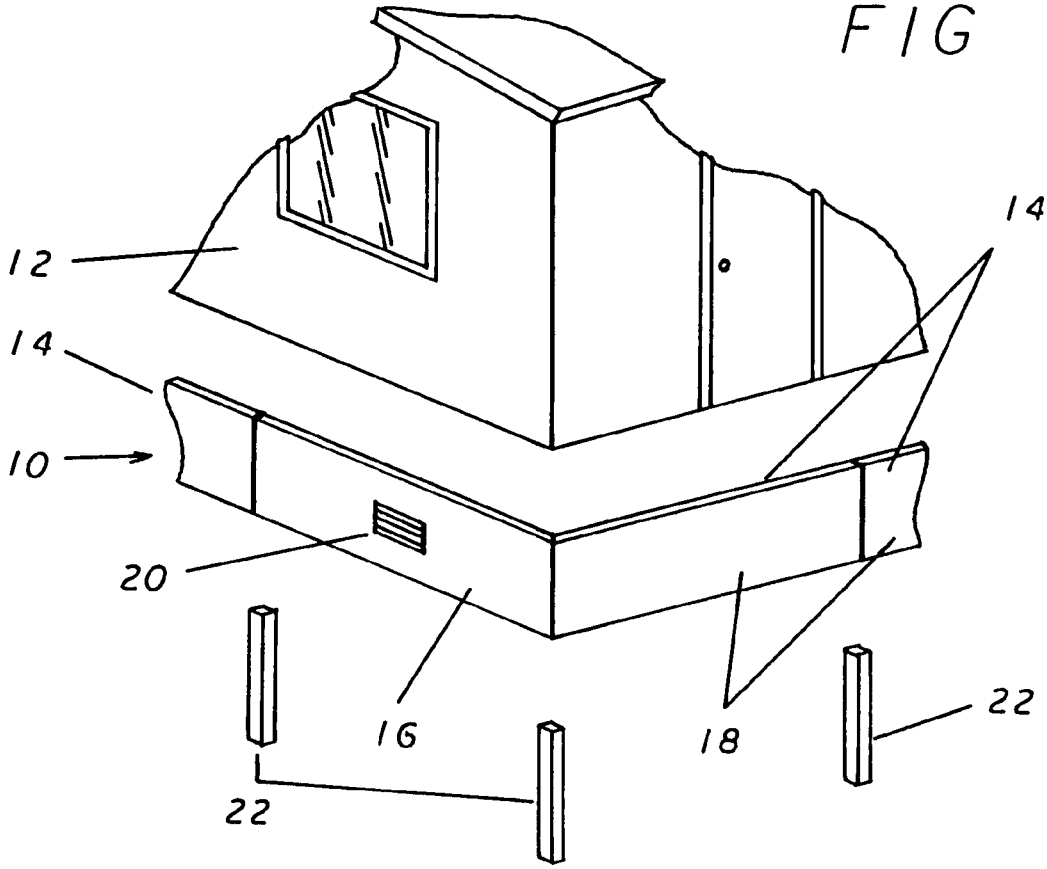
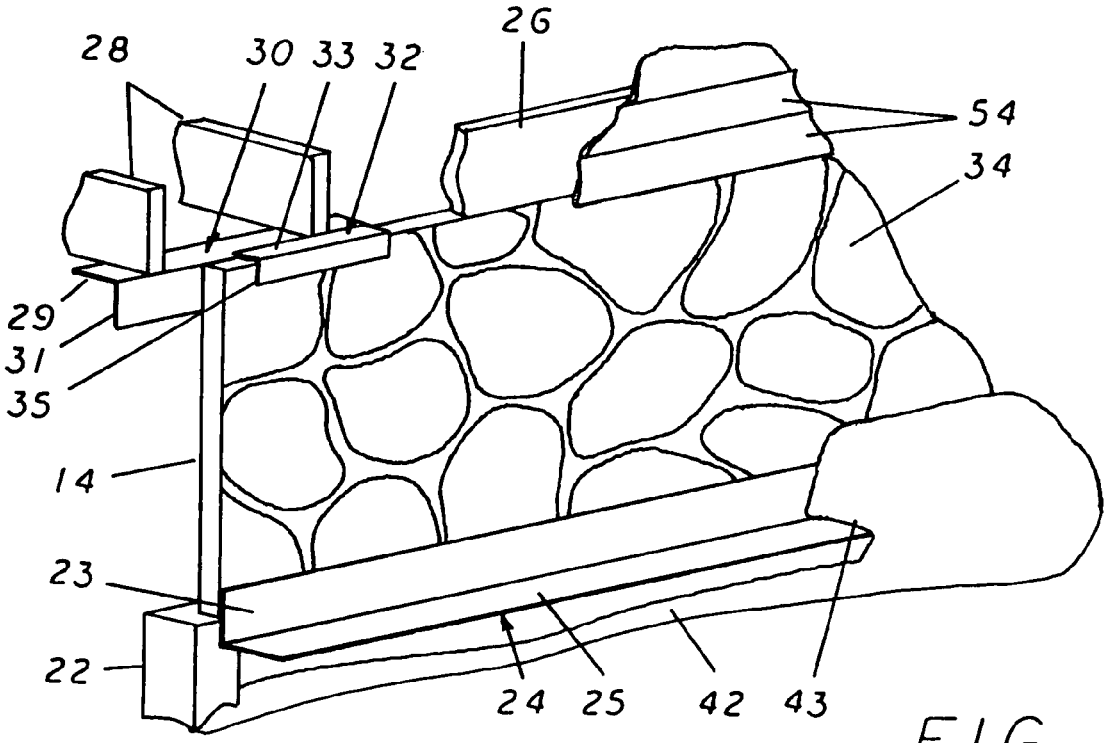
FIG 2

FIG 3
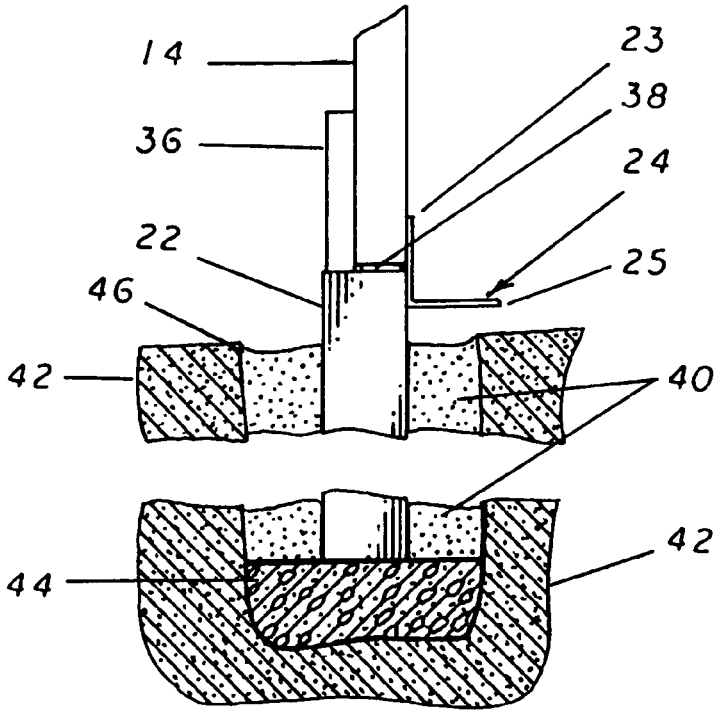
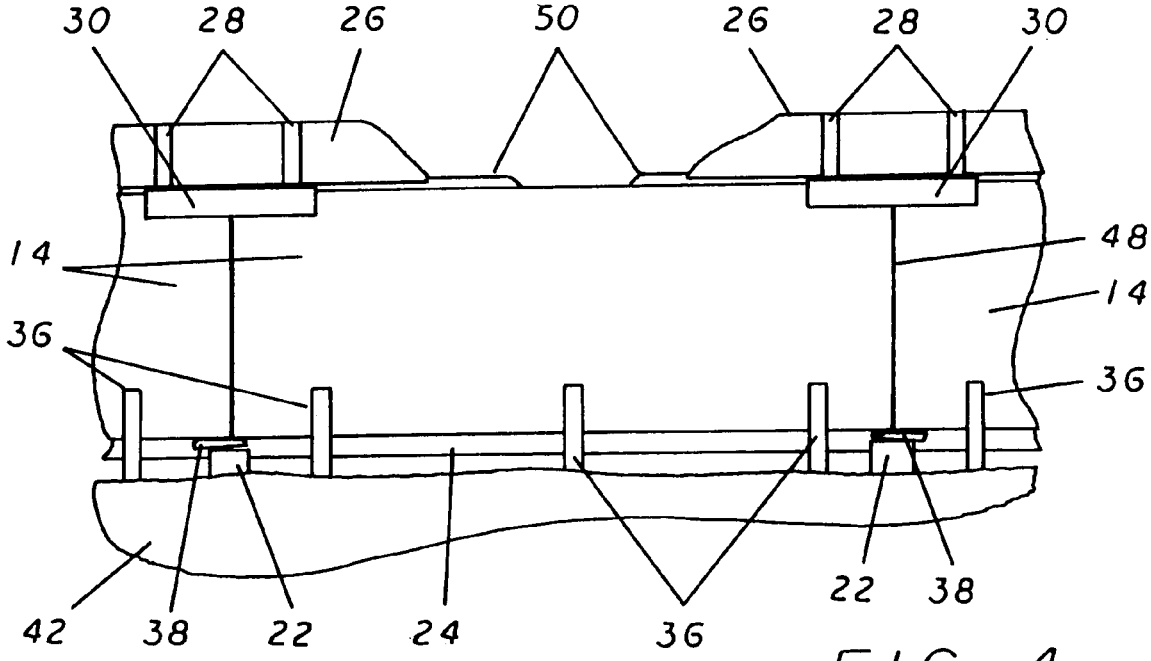
FIG 4

FIG 5
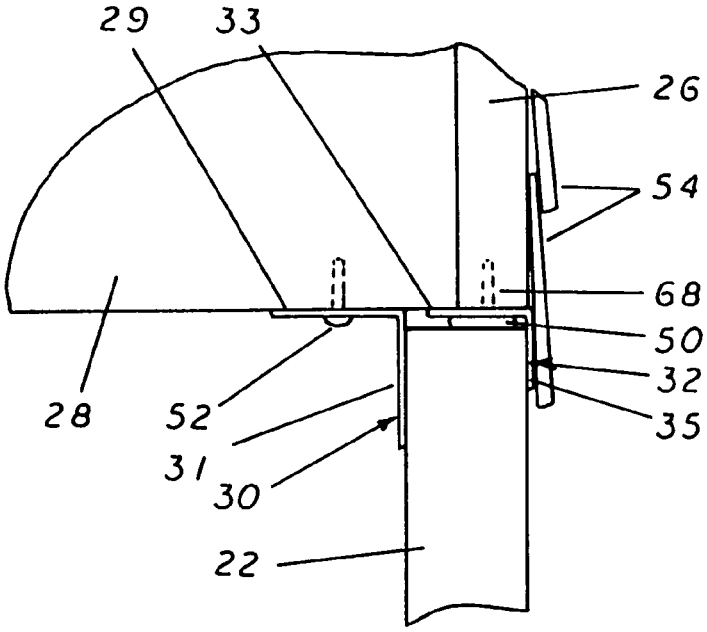
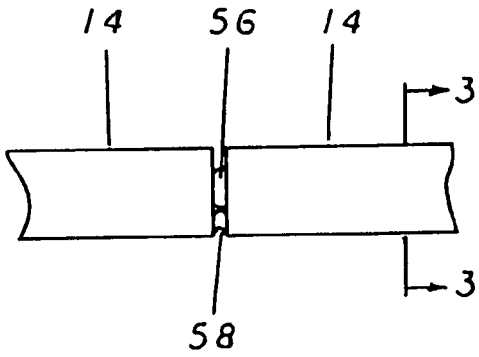
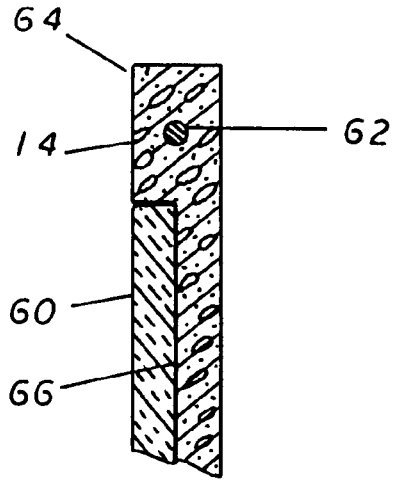
FIG 6
FIG 7

FOUNDATION SYSTEM FOR PREFABRICATED HOUSES

BACKGROUND OF THE INVENTION

The present invention relates to an improvement in the foundation system used on prefabricated structures, such as mobile homes or factory manufactured buildings. More specifically, a foundation system made of a plurality of precast panels that rest on precast posts and not only support the panels but also close in the space between the lower surface of the structure in a manner that is both weather tight and aesthetically pleasing.

In the past, prefabricated structures were positioned at their building sites by the use of a poured concrete slab or conventional concrete footings. The use of these foundation systems created two separate problems. The first of these is that they are relatively labor and material intensive resulting in higher costs that to some degree offset the cost saving advantages that are inherent in the factory built methods of constructing housing or other buildings.

Secondly, these types of foundation systems require an additional mechanism to close off the open space between the bottom surface of the structure's rim joist and the surface of the ground. Typically, this space is closed off by the use of wood, vinyl or sheet metal skirting material. The use of these materials is undesirable because they form a barrier that is insecure and that requires a great deal of maintenance to keep it in a good state of repair. Additionally, the use of such construction materials does not provide a weather tight structure that is often necessary in such structures, especially when they are placed in northern areas where there is a need to provide an insulated space between the structure and the surface of the ground. Finally, the use of these materials results in a finished appearance that clearly indicates that it is a prefabricated structure instead of site-built which is an undesirable result to the eventual owner.

The prior art has examples of attempts to resolve these problems. The first of these is illustrated in U.S. Pat. No. 5,067,289 issued to Ouderkirk which provides a unified wooden foundation and skirting system for these types of structures. The most obvious problems with this solution is that the use of wood for this purpose is that it results in a foundation system that lacks in structural integrity and which is susceptible to durability problems associated with weathering and material rot. Additionally, this foundation system requires the use of a plurality of foundation units being placed in the center area of the structure for further support. This adds a degree of difficulty to the operation as it requires that all of these additional structural components be placed in a manner so that they are all exactly level in relation to themselves and the remaining components of the foundation.

A further solution to this problem is offered in U.S. Pat. No. 6,125,597 issued to Hoffman which provides a foundation and skirting system that employs a plurality of precast concrete panels resting on footing blocks positioned in the ground. The precast panels provide both the foundation and skirting for the prefabricated structure and the blocks are secured in position by the use of anchor rods that extend through them and down into the ground. The problem with this solution is that the placement of the blocks requires the builder dig a trench and prepare that exposed surface in a manner that will adequately support the blocks and the weight of the structure that they carry. This method of construction can result is a susceptibility to settling due to inconsistent ground conditions and types. Additionally, it does not provide a mechanism by which the foundation can compensate for frost heaving conditions that are common in colder climates. Finally, the provided anchoring system for the footing blocks is not secure enough when considering the loads that they must carry during the course of the structure's life.

Therefore, it can be seen that it would be desirable to provide a method of securing a prefabricated structure to a building site that takes advantage of the cost effective nature of such buildings in a manner that not only effectively secures the structure in place but also closes off the area between the bottom of the structure on the surface of the earth. Additionally, it would be desirable to provide a means of closing off this area in a manner that results in an insulated interior space and which results in a finished structure that adds to the aesthetic value of the structure by providing an end product that closely mimics the look of a site built unit.

SUMMARY OF THE INVENTION

It is the primary objective of the present invention to provide a precast foundation system specially designed for prefabricated housing which not only serves to secure the home to the earth but also to enclose their lower structural elements in a weather tight and attractive manner.

It is an additional objective of the present invention to provide such a precast foundation system that does not require that the builder construct concrete footings around the entire perimeter of the prefabricated house which has the effect of reducing building costs through the elimination of excess time and materials in the construction process.

It is a further objective of the present invention to provide such a precast foundation system that is composed of precast concrete panels and posts that can be assembled into their final configuration on site in an efficient and timely manner that will further reduce construction costs by standardizing the materials and methods used in the building of such structures.

It is a still further objective of the present invention to employ such a precast foundation system having external walls that are cast with decorative construction material patterns, such as mimicking brick or natural stone, thereby adding aesthetic value to the structure without incurring the greatly increased construction costs associated with the actual use of these materials.

These objectives are accomplished by the use of a plurality of concrete panels that are cast at a factory location to a predetermined uniform form and size before their transport to a building site. These panels are of a generally rectangular shape and are positioned end to end in a vertical fashion with their shorter sides forming the vertical component of the rectangle. This positioning of the panels forms a wall-like structure around the entire perimeter of a prefabricated structure in a position that corresponds to the location of the rim joist (the external frame of the structure upon which its remaining components are built) of the structure. The lower surface of the panels are then supported by a plurality of precast posts that correspond in position and number to the joints between the plurality of panels. Additionally, these precast posts are positioned in a manner so that the joint between two abutting panels falls at the midpoint of the upper surface of the post. This positioning of the posts relative to the panels ensures that each end of the panels has a solid point of contact through which it can transfer the load of the structure through the post to the earth.

The precast posts are anchored to the earth through the use of a corresponding number of vertical holes evacuated from the ground in a line that matches the outer dimension of the structure and its rim joist. Prior to the precast posts being positioned within the holes, the lowest section of each hole is filled with uncured concrete, or similar material, to form a solid base upon which the post will rest. The concrete forms perfectly to the contours of the inner surface of the hole which effectively transfers the load carried by the posts to the earth by broadening its foot print ensuring that the lower portion of the post will not sink further into the earth than it was designed to. Therefore, the use of the precast posts and their respective concrete bases forms a solid base upon which the panels of the present invention are placed to in turn provide a solid platform upon which the structure is placed. Additionally, the design of the present invention and its major components is resistant to frost heaving and settling ensuring that the structure and its horizontal and vertical surfaces that it supports will remain plum and square, thereby extending its useful life.

The joint between two abutting precast panels is sealed to provide a weather tight fit between the exterior and interior of the panels. This seal is accomplished through the use of a strip of panel joint seal which is a length of compressible foam that is placed between the precast panels prior to their being placed on the precast posts. As the precast panels are forced into their final position, the panel joint seal is squeezed between the two and forms an air tight seal within the joint. This seal is then reenforced by the placement of a bead of all weather caulking in the joint on the outside of the panel joint seal. Thus, the use of the described sealing system ensures a weather tight seal at the joints of abutting precast panels and reduces the risk of frost damage occurring to the precast panels at their joints. Additionally, the joint between the upper surface of the precast panels and the lower surface of the rim joist is sealed with a similar material called the sill seal which is compressed between the two surfaces when the structure is placed on the positioned precast panels.

The precast panels are maintained in the proper vertical orientation by the use of a number of different components. The first of these is a plurality of stakes that are driven into the earth directly behind the inner surface of the precast panels at evenly spaced intervals. The purpose of these stakes is to ensure that the lower edge of the precast panels is not at any time forced inward which could result in their losing contact with the upper surface of the precast posts, a situation that could possibly result in system failure. The upper edge of the precast panels are kept from moving inward by the placement of joist angles that attach to the appropriate floor joists of the structure and extend for a short distance on either side of every panel joint in the body of the invention. Finally., the precast panels are kept from moving outward by the use of the rim joist angles which are attached to the lower surface of the rim joist and bend over the outside edge of the upper surface of the precast panel. Thus, the upper edge of the precast panels are locked between the vertical surfaces of the joist and rim joist angles which keeps them from moving in either an inward or outward manner thereby providing a stable platform upon which a prefabricated structure can be placed.

For a better understanding of the present invention reference should be made to the drawings and the description in which there are illustrated and described preferred embodiments of the present invention.

DESCRIPTION OF THE DRAWINGS

FIG. 1 is a perspective view of the present invention which illustrates the manner in which the precast panels of the present invention are arranged to form a foundation for a prefabricated structure.

FIG. 2 is a perspective view of a precast panel component of the present invention illustrating its manner of construction and the way that it interacts with the appropriate components of the prefabricated structure.

FIG. 3 is a side elevation view of the precast post component of the present invention illustrating the manner in which it is positioned within the hole and its connection to the lower surface of the precast panels.

FIG. 4 is a rear elevation view of a precast panel component of the present invention illustrating the mechanisms used to keep the panels in their proper position after installation between the precast posts and rim joist of the prefabricated structure.

FIG. 5 is a side elevation view of the junction between the upper portion of the precast panel and the rim joist of the prefabricated structure of the present invention illustrating the manner in which it is held in the desired location.

FIG. 6 is a top elevation view of the joint between two abutting precast panels of the present invention illustrating the use of panel joint seal and caulking to provide a weather tight seal between the interior and exterior of the wall formed by the connection of the panels.

FIG. 7 is a side elevation cut-away view of precast panel component of the present invention taken along line 3 of FIG. 6 and illustrating the manner of construction of the precast panels.

DESCRIPTION OF THE PREFERRED EMBODIMENT

Referring now to the drawings, and more specifically to FIG. 1 which illustrates the general configuration of the precast foundation 10 and its position relative to the prefabricated structure 12 (in the present instance illustrated as a prefabricated single family home). As illustrated, the precast panels 14 are lined up end to end to form a wall-like structure that forms an enclosing skirt that surrounds the lower perimeter of the prefabricated structure 12. Additionally, the precast panels 14 are either end wall panels 16 or side wall panels 18. The end and side wall panels, 16 and 18, differ only in the fact that the end wall panels 16 can be equipped with vents 20 which provide a mechanism by which the air space beneath the prefabricated structure 12 can interact with the air on the outside. This ensures that the air contained within the space defined by the outside edge of the precast panels 14 will be maintained at the proper temperature and moisture content to avoid the structural problems associated with sharp temperature and humidity contrasts.

This FIGURE also illustrates the positioning of the precast posts 22 relative to the remaining components of the present invention. The precast posts 22 are the components of the present invention which provide the base upon which the precast panels 14 are placed to form a foundation for a prefabricated structure 12. The use of the precast posts 22 allows a prefabricated structure 12 to be positioned in a stable manner without requiring that the builder pour footings prior to the placement of the prefabricated structure 12. Therefore, the use of the present invention allows a prefabricated structure 12 to be positioned at a job sight in a manner that requires less time and materials which has the effect of dramatically reducing the costs associated with this type of construction.

The manner in which the precast panels 14 are constructed and the way in which they interact with specific components of the prefabricated structure 12 are further detailed in FIG. 2. The most prominent feature of the precast panel in this illustration is the decorative panel pattern 34 that is cast into the face of the precast panel 14 during the manufacturing process. This feature adds a degree of aesthetic value to the finished product by giving the face of the present invention a brick or stone-like appearance without incurring the great deal of added expense associated with the use of these types of natural building materials.

This FIGURE also illustrates the manner in which the precast panel 14 engages the pertinent components of the prefabricated structure 12 when installation is complete. The upper most surface of the precast panels 14 provides the platform upon which the rim joist 26 of the prefabricated structure 12 rests. Inside of the rim joist 26 a plurality of floor joists 28 extend perpendicularly across the interior of the prefabricated structure 12. The ends of some of these floor joists 28 serve as the mounting point for the joist angle 30 which is employed to keep the upper surface of the precast panels 14 from falling inward after the prefabricated structure 12 has been placed in the finished position. The joist angle 30 is a relatively short section of large angle iron of which the joist angle horizontal surface 29 is placed against the lower surfaces of a pair of neighboring floor joists 28 and secured thereto. The other surface of the joist angle 30, the joist angle vertical surface 31, then extends downward at a right angle and in a position that is parallel to the line formed by the inner wall of the rim joist 26 and the outer butt ends of the floor joists 28. This joist angle vertical surface 31 of the joist angle 30 limits range of possible motion for the upper surface of the precast panels 14 ensuring that they stay in the proper position relative to the rim joist 26. Additionally, the joist angles are positioned laterally in relation to the plurality of precast panels 14 so that they extend into both bodies of two neighboring precast panels 14. This configuration allows one joist angle 30 to secure the end of two neighboring precast panels 14 ensuring the maximum economy of use of this component of the present invention.

The present invention also makes use of an additional device formed from a section of angle iron called a rim joist angle 32. The rim joist angle 32 is positioned in roughly the same location as the joist angle 30 except for the fact that the rim joist angle horizontal surface 33 is located on top of the precast panel 14 between it and the lower surface of the rim joist 26. The rim joist angle vertical surface 35 of the rim joist angle 32 that extends at a right angle fits over the outer surface (that containing the decorative panel pattern 34) of the precast panels 14. This manner of construction serves two purposes. The first of these is to help to secure the precast panels 14 in their upright position by keeping them from moving in an outward manner, therefore working in conjunction with the joist angle 30 to hold the upper portion of the precast panel 14 in the proper orientation. Secondly, the rim joist angle 32 serve to provide a spacing function which serves to provide and maintain a gap between the outer surface of the precast panels 14 and the inner surface of the house siding panels 54. This provides a more professional looking joint between the prefabricated structure 12 and the present invention thereby enhancing the overall aesthetics of its use.

Finally, this FIGURE also illustrates the use of the dirt guard 24 which is another section of angle iron similar in its lateral dimension to that of the joist angle 30 but extending for the entire length of each precast panel 14. The dirt guard 24 attaches to the lower surface of the precast panels 14 in a manner so that the dirt guard vertical surface 23 extends down past the lowest point of the precast panel 14. With this manner of attachment, the dirt guard horizontal surface 25 extends outward from the base of the dirt guard vertical surface 23 forming a shelf-like configuration. The primary purpose of the dirt guard is to keep fill dirt and landscaping material from getting under the precast panels 14 while allowing landscape material to be pushed up over the dirt guard horizontal surface 25 to contact the outer surface of the precast panels 14. This is an important aspect of the design of the present invention because, as illustrated in FIG. 3, the lowest edge of the precast panels 14 is positioned by the use of the precast posts 22 so that there is a space between it and the surface of the ground 42. This design ensures that any frost heaving occurring in the ground 42 during cold weather will not affect the integrity of the present invention thereby ensuring that the prefabricated structure 12 will not be damaged by such natural occurrences. Additionally, this FIGURE also illustrates the manner in which the end of each precast panel 14 only occupies about one half of the upper exposed surface of the precast post 22. This allows the ends of two neighboring precast panels 14 to be anchored on a single precast post 22.

FIG. 3 also illustrates the manner in which the precast posts 22 are positioned within the post holes 46 that were dug within the ground 42 prior to the beginning of the installation of the present invention. Prior to the placement of a precast post 22, the bottom most portion of the post hole 46 is filled to a predetermined level with one form of the many types of concrete available today. This creates a concrete foundation 44 upon which the bottom of the precast post 22 rests, the purpose of which is to dissipate the load carried by the precast post 22 into a larger part of the ground 42. This design ensures that the precast post 22 will not settle into the ground 42 and affect the integrity of the present invention and the prefabricated structure 12 which it carries.

Once the precast post has been placed in the desired position, the remaining open area of the post hole 46 is filled in with fill sand 40 to ensure that it stays in the proper orientation. This fill sand 40 is left in an unpacked condition during the installation of the present invention so that the precast posts 22 can be adjusted to obtain the exact orientation that is required by the installation. Once this has been accomplished and the critical components of the present invention are in the desired location, the fill sand 40 is then packed tightly around the precast posts 22 to ensure that they do not subsequently shift their position.

Further features of the present invention that are employed to properly position the precast panels 14 are illustrated in FIG. 4 which details their rear surface and the manner in which the ends of two neighboring precast panels 14 engage the upper surface of a single precast post 22. This positioning of the precast panels 14 is illuminated by the position of the panel joints 48 which extend vertically upwards from the center of the precast posts 22 and are the junctions of the two neighboring precast panels 14. The panel joints 48 also illustrate the manner in which the joist angles 30 span the upper outside corners of each of the precast panels 14 to hold the precast panels 14 on the proper location and their relation to the floor joists 28 and rim joist 26. Additionally, this FIGURE also shows the location of the sill seal 50 which is used to create a weather tight seal between the upper surface of the precast panels 14 and the lower surface of the rim joist 26.

Also employed to hold the precast panels 14 in the proper location are a plurality of anchor posts 36 which are essentially relatively short stakes that are driven into the ground 42 along the inner and lower edge of the precast panels 14. These anchor posts 36 are placed in this fashion to ensure that the lower edge of the precast panels 14 cannot be forced inwards during backfilling or landscaping work. Finally, the use of panel shims 38 is illustrated to detail an additional available method of leveling and positioning the precast panels 14 during the installation process. The panel shims 38 are made of a corrosion resistant material enabling them to last for the life of the structure and are driven between the upper surface of the precast posts 22 and the lower surfaces of the precast panels 14 to adjust the height of their upper surfaces. The use of the panels shims 38 provides a method of fine tuning the final position of the precast panels 14 and, therefore, the final position of the prefabricated structure 12.

The joint between the upper surface of the precast panels 14 and the rim and floor joists, 26 and 28, is further detailed in FIG. 5. Specifically, the position of the joist angle 30 in relation to the floor joist 28 and the upper edge of the precast panels 14 are shown. Additionally, the way the joist angle attachment screw 52 is employed to securely fasten the joist angle 30 in place on the lower surfaces of the floor joists 28 is also clearly illustrated by this FIGURE. The sill seal 50 is sandwiched between the rim joist 26 and the precast panel 14 and which also runs under the rim joist angle 32 in the locations where it is positioned to maintain the location of the precast panels 14. As previously stated, the sill seal 50 is the component of the present invention that provides an air and weather tight seal between the rim joist 26 and the precast panels 14 to ensure that the elements cannot affect the integrity of the interior components.

The positioning of the rim joist angle 32 and the use of the rim joist angle attachment screw 68 to anchor it to the bottom of the rim joist 26 is also illustrated in FIG. 5 which clearly shows the manner in which the rim joist angle vertical surface 35 is used to restrict the movement of the precast panels 14. Additionally, the spacing function of the rim joist angle 32 is illustrated in which the thickness of the rim joist angle vertical surface 35 is employed to keep the lower edge of the house siding panels 54 from contacting the outer surface of the precast panels 14. This method of construction keeps moisture from collecting at this point and provides a more professional looking joint between the prefabricated structure 12 and the precast panels 14 of the present invention.

The manner of construction of the panel joint 48 is further illustrated in FIG. 6 which details the position of the panel joint seal 56 between two neighboring precast panels 14. Additionally, once the precast panels 14 have been properly positioned and the panel joint seal 56 has been compressed within the panel joint 48, a bead of joint caulking 58 is placed on the outside of the panel joint seal 56 relative to the inner and outer surfaces of the precast panels 14 within the panel joint 48. The use of the joint caulking 58 extends the life of the panel joint 48 by keeping the elements from acting upon the panel joint seal 56 and causing its deterioration. Thus, with the proper care, the panel joint 48 and the panel joint seal 56 will last for the useful life of the prefabricated structure 12 and the present invention.

The internal manner of construction of the precast panels 14 is illustrated in FIG. 7 which is a cross-section view of a single precast panel 14 taken along line 3 of FIG. 6. The cross-sectional view illustrates the use of the panel frame 64 which is a thickened area of the precast panel 14 that surrounds its perimeter. The panel frame 64 provides a greater degree of strength to the precast panels 14 which is enhanced by the use of steel bar 62 running through its entirety. Additionally, the use of the insulation depression 66 is illustrated which is a relatively shallow depression in the body of the precast panel 14 relative to its interior surface and which makes room for the insertion of the insulation 60 within the body of the present invention. The use of the insulation 60 enhances the performance of the precast panels 14 as it provides a greater degree of heat retention and exclusion properties to the invention which the designer and builder can take advantage of to improve the performance of the prefabricated structure 12 when used in conjunction with the present invention.

Although the present invention has been described in considerable detail with reference to certain preferred versions thereof, other versions are possible. Therefore, the spirit and scope of the appended claims should not be limited to the description of the preferred versions contained herein.

What is claimed is:

1. A foundation system for prefabricated structure, said structure having an outer rim joist having a lower surface and a plurality of floor joists, said foundation system comprising:

a plurality of rectangular load bearing precast panels, said precast panels having a front surface, a rear surface, a first and second end edge, a top edge and a bottom edge, said precast panels arranged first edge to second edge so as to form a precast panel joint, said precast panels being arranged so as to match said lower surface outer rim joist of said prefabricated structure;

a substantially buried elongate precast post having a bottom surface and a top surface at each of said precast panel joints such that the bottom edge of two precast panels rest on said top surface of said precast post;

a plurality of joist angle iron sections having a horizontal surface for receiving said floor joists, said joist angle iron sections further having a vertical surface abutting said rear surface of said precast panels; and a plurality of elongate laterally spaced anchor posts having a bottom section and top section, said bottom section of said anchor post being buried and said top section of said anchor post abutting the rear surface of said precast panels, a plurality of rim joist angle iron sections having a horizontal surface for receiving said rim joists, said rim joist angle iron sections further having a vertical surface abutting the front surface of said precast panels.

2. A foundation system as in claim 1 further comprising an elongate angle iron dirt guard along said front surface and said bottom edge of said precast panels.

3. A foundation system as in claim 2 further comprising a buried poured concrete section at the bottom surface of each of said buried precast posts.

4. A foundation system as in claim 3 further comprising a strip of sill seal between said horizontal surface of said rim joist angle iron and said top edge of said precast panels.

5. A foundation system as in claim 4 further comprising a strip of insulation in each of said precast panel joints.

6. A foundation system as in claim 5 wherein said joist angle iron sections are adapted to be fixedly attached to said floor joists with a plurality of fasteners.

7. A foundation system as in claim 6 further comprising compacted sand to bury said anchor posts.

8. A foundation system as in claim 7 wherein each precast panel further comprises an insulation backer board on said rear surface.

9. A foundation system as in claim 8 wherein each precast panel defines a panel pattern on said front surface of said precast panel.

10. A precast panel foundation system for a structure, said structure having an outer rim joist with a lower surface and a plurality of floor joists, said precast panel foundation system comprising:

a plurality of load bearing rectangular concrete precast panels, said concrete panels having a front surface, a rear surface, a first and second end edge, a top edge and a bottom edge, said concrete panels arranged first edge to second edge so as to form a precast panel joint, said concrete panels being arranged so as to match said outer rim joists lower surface of said prefabricated structure;

a insulation backer board on said rear surface of said concrete panels;

a substantially buried elongate precast post a having a bottom surface and a top surface at each of said precast panel joints such that the bottom edge of two panels rest on said top surface of said precast post;

a buried poured concrete section at the bottom surface of each of said buried precast posts;

a plurality of joist angle iron sections having a horizontal surface for receiving said floor joists, said joist angle iron sections further having a vertical surface abutting said rear surface of said precast panels; and a plurality of elongate laterally spaced anchor posts having a bottom section and top section, said bottom section of said anchor post being buried and said top section of said anchor post abutting the rear surface of said precast panels, a plurality of rim joist angle iron sections having a horizontal surface for receiving said rim joists, said rim joist angle iron sections further having a vertical surface abutting the front surface of said concrete panels.

11. A foundation system as in claim 10 further comprising an elongate angle iron dirt guard along said front surface and said bottom edge of said precast panels.

12. A foundation system as in claim 11 further comprising a strip of sill seal between said horizontal surface of said rim joist angle iron and said top edge of said precast panels.

13. A foundation system as in claim 12 further comprising a strip of insulation in each of said precast panel joints.

14. A foundation system as in claim 13 wherein said joist angle iron sections are prepared to be fixedly attached to said floor joists with a plurality of fasteners.

15. A foundation system as in claim 14 further comprising compacted sand to bury said anchor posts.

16. A foundation system as in claim 15 wherein each precast panel defines a decorative molded panel pattern on said front surface of said precast panel.

17. A precast panel foundation system for a structure, said structure having an outer rim joist with a lower surface and a plurality of floor joists, said precast panel foundation system comprising:

a plurality of load bearing rectangular concrete precast panels, said concrete panels having a front surface, a rear surface, a first and second end edge, a top edge and a bottom edge, said concrete panels arranged first edge to second edge so as to form a precast panel joint, said concrete panels being arranged so as to match said outer rim joists lower surface of said prefabricated structure;

wherein each of said plurality of precast panels includes an insulation backer board on said rear surface of said concrete panels and a decorative molded panel pattern on said front surface of said precast panel;

wherein said insulation backer board is positioned within a depression of said precast panel, wherein said depression extends within said rear surface of said precast panel;

a substantially buried elongate precast post a having a bottom surface and a top surface at each of said precast panel joints such that the bottom edge of two panels rest on said top surface of said precast post;

a buried poured concrete section at the bottom surface of each of said buried precast posts, wherein said precast post is positioned upon said concrete section;

a plurality of joist angle iron sections having a horizontal surface for receiving said floor joists, said joist angle iron sections further having a vertical surface abutting said rear surface of said precast panels;

a plurality of elongate laterally spaced anchor posts having a bottom section and top section, said bottom section of said anchor post being buried and said top section of said anchor post abutting the rear surface of said precast panels;

a plurality of rim joist angle iron sections having a horizontal surface for receiving said rim joists, said rim joist angle iron sections further having a vertical surface abutting the front surface of said concrete panels;

an elongate angle iron dirt guard extending along an entire said front surface and said bottom edge of said precast panels;

a strip of sill seal between said horizontal surface of said rim joist angle iron and said top edge of said precast panels;

a strip of insulation in each of said precast panel joints;

wherein said joist angle iron sections are prepared to be fixedly attached to said floor joists with a plurality of fasteners; and a mass of compacted sand to bury said anchor posts.

* * * * *